US006914181B2

(12) United States Patent
Toshitani

(10) Patent No.: US 6,914,181 B2
(45) Date of Patent: Jul. 5, 2005

(54) DIGITAL INTERFACE FOR ANALOG MUSICAL INSTRUMENT

(75) Inventor: Masafumi Toshitani, Hamamatsu (JP)

(73) Assignee: Yamaha Corporation, Shizuoka-ken (JP)

( * ) Notice: Subject to any disclaimer, the term of this patent is extended or adjusted under 35 U.S.C. 154(b) by 164 days.

(21) Appl. No.: 10/374,348

(22) Filed: Feb. 25, 2003

(65) Prior Publication Data

US 2003/0159570 A1 Aug. 28, 2003

(30) Foreign Application Priority Data

Feb. 28, 2002 (JP) ..... 2002-054562

(51) Int. Cl.[7] ..... G10H 7/00
(52) U.S. Cl. ..... 84/645; 84/609; 84/649
(58) Field of Search ..... 84/600, 602–603, 84/609–610, 615, 645, 649–650, 653, 737, 743

(56) References Cited

U.S. PATENT DOCUMENTS 5,393,926 A * 2/1995 Johnson ..... 84/610
5,491,297 A * 2/1996 Johnson et al. ..... 84/609
5,670,729 A * 9/1997 Miller et al. ..... 84/609
5,723,802 A * 3/1998 Johnson et al. ..... 84/609
5,902,949 A * 5/1999 Mohrbacher ..... 84/609
6,353,169 B1 * 3/2002 Juszkiewicz et al. ..... 84/600
6,686,530 B2 * 2/2004 Juszkiewicz et al. ..... 84/600
2004/0103776 A1 * 6/2004 Juszkiewicz et al. ..... 84/742
2004/0144241 A1 * 7/2004 Juskiewicz et al. ..... 84/723
2004/0168566 A1 * 9/2004 Juskiewicz et al. ..... 84/723

FOREIGN PATENT DOCUMENTS

JP 7-43715 9/1995

* cited by examiner

*Primary Examiner*—Marlon Fletcher
(74) *Attorney, Agent, or Firm*—Harness, Dickey & Pierce, P.L.C.

(57) ABSTRACT

A digital interface apparatus is provided for use in an analog musical instrument capable of generating an analog audio signal, and is designed for interfacing with an external digital audio apparatus. In the digital interface apparatus, an input/output interface converts the analog audio signal generated by the analog musical instrument into a digital audio signal. The input/output interface has an input terminal and an output terminal for transmitting the digital audio signal to the external digital audio apparatus and for receiving a digital audio signal from the external digital audio apparatus. A digital signal processor processes the digital audio signal which is either converted from the analog audio signal or received from the input terminal. A main controller controls operation of the digital signal processor according to instructions. An operating member is manually operated to provide the instructions to the main controller.

10 Claims, 5 Drawing Sheets

DIGITAL INTERFACE FOR ANALOG MUSICAL INSTRUMENT

BACKGROUND OF THE INVENTION

1. Technical Field of the Invention

The present invention relates to an interface apparatus connecting analog musical instruments such as an electric guitar and an electric base guitar with audio-visual equipments such as a personal computer and a stereo unit. More particularly, the present invention relates to such a digital interface apparatus for analog musical instruments that converts an analog audio signal generated by the analog musical instrument into a digital audio signal, and outputs the digital audio signal to an AV equipment. The present invention also relates to an analog musical instrument equipped with that digital interface.

2. Prior Art

Normally, a so-called electric musical instrument such as an electric guitar and an electric base guitar is a standalone and isolated device, and outputs only an analog audio signal, i.e., an analog electric signal generated by playing the electric musical instrument. The electric musical instrument converts vibration of a string or the like into an analog electric signal, amplifies the analog electric signal with an amplifier or the like, and generates instrumental sounds. The electric musical instruments include an electric guitar, an electric base guitar, and the like of solid type (having no hollow in the body) designed to generate instrumental sounds electrically. By contrast, an acoustic musical instrument generates instrumental sounds through vibration of a string and the like without using an analog electric signal. The acoustic musical instruments include a classic guitar, a wood base, a violin, a cello, and the like. These natural instruments generate sounds acoustically and amplify it through the use of a hollow or the like in the instrument body. The electric musical instruments are considered to include an acoustic musical instrument that has a piezoelectric element and the like capable of converting the generated vibration into an analog electric signal.

As mentioned above, the electric musical instrument outputs only analog audio signals. In fact, it is difficult that another equipment such as an AV equipment controls the electric musical instrument, and vice versa. It has been difficult to provide bidirectional control between the electric musical instruments and the external AV equipments. Generally, the electric musical instrument cannot control other AV equipments. To play music, for example, an output analog audio signal is input to a dedicated peripheral device such as a pre-amplifier and a power amplifier where the signal is adjusted to a specified timbre and is amplified to a specified volume. Finally, the signal is output from an output device such as a speaker. During this musical performance, for example, a tone change may be added to the analog audio signal output from the electric musical instrument. In this case, it is a general practice to control the tone by providing an additional effector device and the like between the electric musical instrument and the pre-amplifier or between the pre-amplifier and the power amplifier.

Since the electric musical instrument outputs an analog audio signal, an additional digital device is required to digitize analog audio signals in order to process these signals by a digital effector, for example. Likewise, an additional converter or the like is required for a digital musical instrument such as a personal computer to process analog audio signals output from the electric musical instrument. The use of the electric musical instrument in a digital environment requires addition of digital devices other than the electric musical instrument, thereby causing a problem of increasing hardware costs. If a digital device and the like are added, these devices are controlled by operating an additional operation system. For example, it is difficult for a player of the electric musical instrument to change or adjust tones at hand. If the electric musical instrument is connected to a digital device such as a computer, it is possible to provide control at least from the electric musical instrument to the digital device. This enables, for example, to edit an output musical sound and the like at hand, making it possible to improve convenience for players.

SUMMARY OF THE INVENTION

The present invention has been made in consideration of the foregoing. It is therefore an object of the present invention to provide a digital interface apparatus and an analog musical instrument having the same, wherein the digital interface apparatus can convert an analog audio signal output from analog musical instruments into a digital audio signal, process the converted digital audio signal representative of a musical sound and output the same to AV devices, and provide bidirectional control in connection with the AV devices. Here, analog musical instruments include electric musical instruments such as an electric guitar and which an electric base guitar which convert string vibration into an analog audio signal and amplify the analog audio signal using an amplifier and the like for sounding, and acoustic musical instruments which can be equipped with a piezoelectric element, a microphone, an electromagnetic pickup, and the like, and convert a played sound into an analog audio signal for output.

In one aspect of the invention, a digital interface apparatus is provided for use in an analog musical instrument capable of generating an analog audio signal, and is designed for interfacing with an external digital audio apparatus. The digital interface apparatus comprises an input/output interface for converting the analog audio signal generated by the analog musical instrument into a digital audio signal, the input/output interface having an input terminal and an output terminal for transmitting the digital audio signal to the external digital audio apparatus through the output terminal and for receiving a digital audio signal from the external digital audio apparatus through the input terminal, a signal processor for processing the digital audio signal which is either converted from the analog audio signal or received from the input terminal, a main controller for controlling operation of the signal processor according to instructions, and an operating member manually operative to provide the instructions to the main controller.

In another aspect of the invention, an analog musical instrument comprises a generator for generating an analog audio signal representative of a musical instrument sound, an input/output interface for converting the analog audio signal generated by the generator into a digital audio signal, the input/output interface having an input terminal and an output terminal for transmitting the digital audio signal to an external digital audio apparatus through the output terminal and for receiving a digital audio signal from an external digital audio apparatus through the input terminal, a signal processor for processing the digital audio signal which is either converted from the analog audio signal or received from the input terminal, a main controller for controlling operation of the signal processor according to instructions, and an operating member manually operative to provide the instructions to the main controller.

According to the present invention, the digital interface apparatus of the analog musical instrument includes the input/output interface and the signal processor. For example, a digital audio signal converted from a musical instrument sound can be directly output to an external digital AV apparatus and the like. Accordingly, it is possible to suppress hardware investment costs of additional digitizing devices and the like that digitize the analog audio signal and digitally handle the analog musical instrument. Since the operating member can issue a command to control the signal processor, a user can apply musical sound signal processing such as effect processing to the digital audio signal at hand, thereby improving operability. In addition, there is provided the input/output interface having the digital input/output terminal. For example, it is expected to provide bidirectional control in such a manner that the operating member controls music software installed in the externally connected digital apparatus, and vice versa the external apparatus and the like control operations of the signal processor.

Preferably, the inventive digital interface apparatus further comprises a bus controller for controlling a bus connecting between the main controller and one or more of the external digital audio apparatus having a CPU through the input/output interface for bi-directionally transferring audio data including the digital audio signal and a digital control signal effective to control processing of the digital audio signal, the bus controller being operative in a stream mode for transferring the digital audio signal in a stream of packets at a constant rate, and being operative in a burst mode for transferring the digital control signal in a burst form. Further, the inventive digital interface apparatus comprises a clock generator for generating a clock signal adaptively set for operating signal processor and the input/output interface in synchronization with a word clock used by the CPU of the external digital audio apparatus such as a personal computer, so that the digital audio signal can be transferred synchronously between the digital interface apparatus and the external digital audio apparatus. Consequently, the user can manipulate the operating member of the digital interface apparatus to control operations of the software and the like installed in a plurality of computers based on accurate synchronization. This makes it possible to provide bidirectional control with a plurality of external digital equipments.

It is preferable that the signal processor processes the digital audio signal to impart thereto a desired effect. Accordingly, the digital interface apparatus can directly apply an effect to the digital audio signal and output the signal as digital data to external devices and the like.

It is also preferable that the digital interface apparatus further comprises a switch member operable to switch the operating member between an analog mode and a digital mode, such that the operating member operates under the digital mode for inputting the instructions to the main controller, and operates under the analog mode for directly controlling at least a volume or a tone of the analog audio signal generated by the analog musical instrument.

Further, it is desirable that the digital interface is detachably mounted on or undetachably integrated in the analog musical instrument body such as an electric guitar and an electric base guitar. When the digital interface apparatus is mounted on or integrated in the analog musical instrument body, a player or the like can provide digital effect processing and cooperate with other connected external devices and the like at hand, thereby improving the controllability and the operability of the music network system.

DETAILED DESCRIPTION OF THE INVENTION

Embodiments of the present invention will be described in further detail with reference to the accompanying drawings.

In the specification, the analog musical instrument means a musical instrument that outputs an analog audio signal. The analog musical instruments include electric musical instruments such as an electric guitar and an electric base guitar which convert string vibration into an analog audio signal and amplify the analog audio signal using an amplifier and the like for sounding; and acoustic musical instruments which can be equipped with a piezo-electric element, a microphone, an electromagnetic pickup, and the like, and convert a played instrument sound into an analog audio signal for output. Anyway, the analog musical instrument has a generator for generating the analog audio signal representative of a musical instrument sound.

Figure 1:
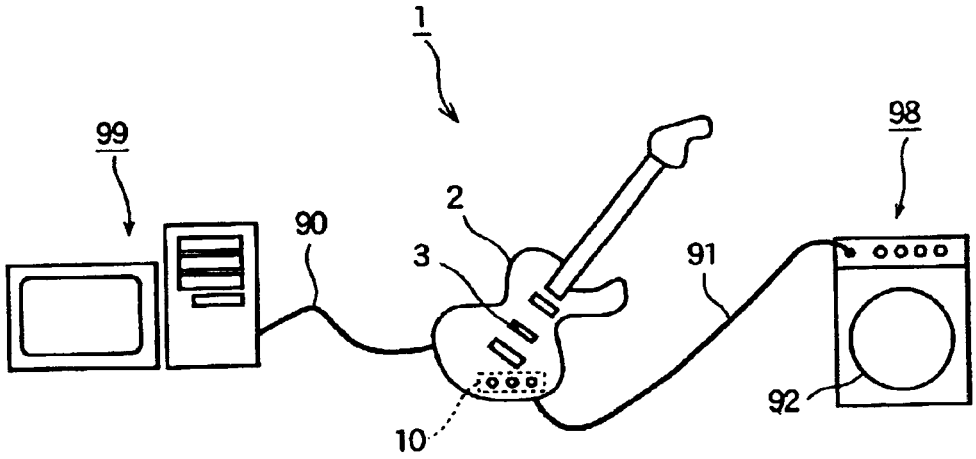
FIG. 1 exemplifies an analog musical instrument according to an embodiment of the present invention with a built-in digital interface apparatus.

FIG. 1 exemplifies an analog musical instrument according to an embodiment of the present invention with a built-in digital interface apparatus.

As shown in FIG. 1, a digital interface apparatus (hereafter referred to as "D·I/F") 10 of the analog musical instrument according to this example is built in a body 2 of an electric guitar (hereafter referred to as "EG") 1 as the analog musical instrument. The D·I/F 10 housed in the EG 1 is directly wired to a pickup 3 that is attached to the body 2 of the EG 1, detects string vibration of the EG 1, and converts the vibration into an analog electric signal. Namely, the pickup constitutes a generator for generating the analog audio signal. The D·I/F 10 is connected to a computer (hereafter referred to as "PC") 99 via a cable 90 connected to a digital input/output terminal of an input/output device interface (hereafter referred to as "input/output device I/F") to be described later. Further, the D·I/F 10 is connected to a guitar amplifier 98 that houses a pre-amplifier and a power amplifier and is equipped with a speaker 92 as a sound output apparatus via an analog shield cable 91 connected to an analog output terminal of the input/output device I/F.

Figure 2:
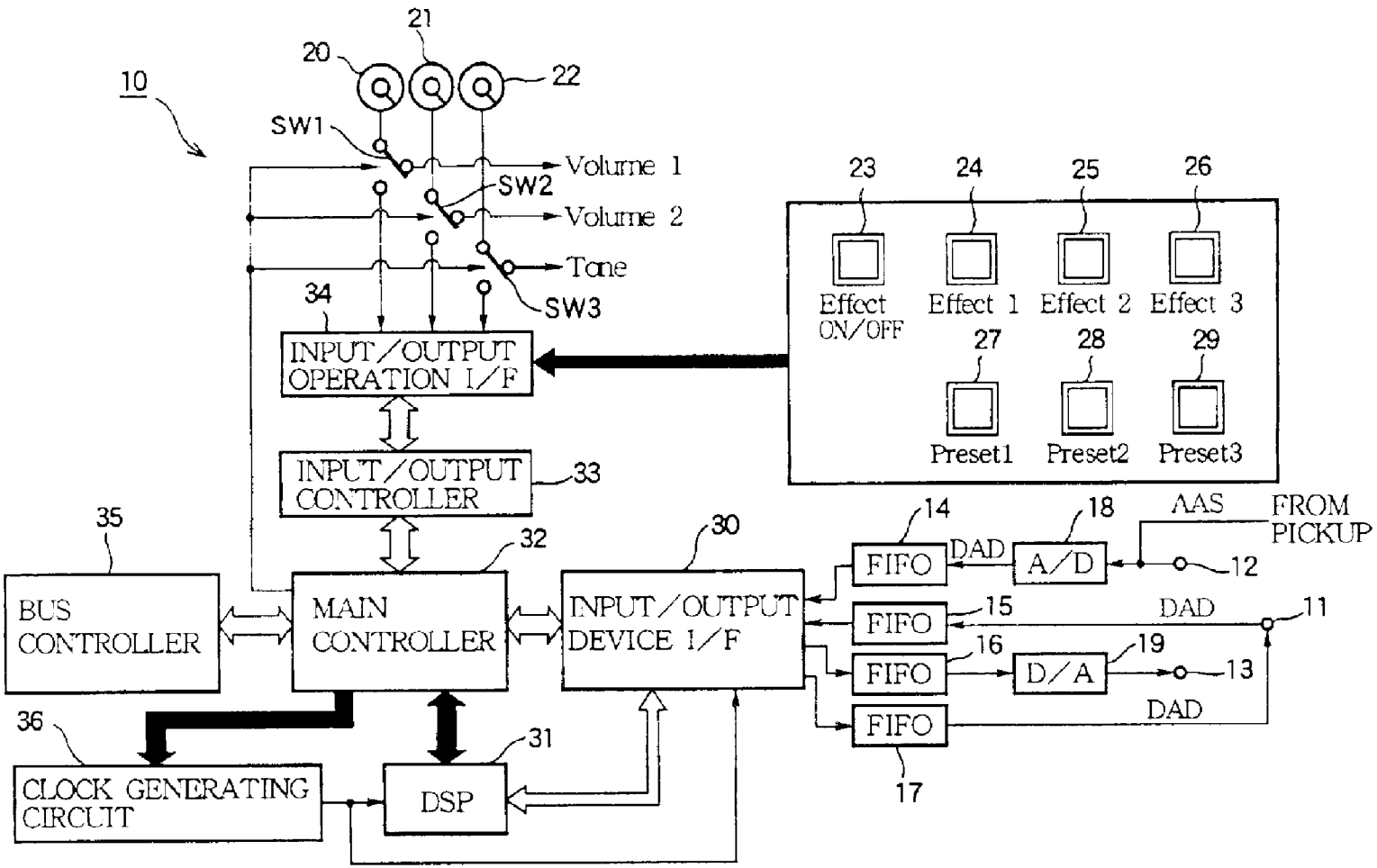
FIG. 2 is a block diagram showing an essential part of the configuration of the digital interface apparatus.

FIG. 2 is a block diagram showing an essential part of the configuration of the D·I/F 10. As mentioned above, a cable 90 connected to the PC 99 is connected to a digital input/output terminal 11 supplied in the D·I/F 10, for example. Accordingly, FIFO 15 stores digital audio data (hereafter referred to as "DAD") such as a digital audio signal supplied to the D·I/F 10 from the PC 99 and a control signal of the EG 1. The DAD is then output to an input/output device I/F 30.

The DAD supplied to PC 99 from the D·I/F 10 is stored in FIFO 17 from the input/output device I/F 30, and then is output to the PC 99 via the digital input/output terminal 11 and the cable 90. It should be noted that the DAD includes a digital audio signal and a control signal. The digital input/output terminal 11 is available as, e.g., a USB (Universal Serial Bus) terminal, an IEEE (The Institute of Electrical and Electronics Engineers, Inc.) 1394 terminal, and the like.

A string, plucked during performance, causes vibration. The pickup 3 of EG 1 detects this vibration, converts the vibration into an electric signal, and outputs the signal as an analog audio signal. An A/D converter 18 digitally converts the analog audio signal (hereafter referred to as "AAS") detected and converted into an electric signal by the pickup 3 of the EG 1 and another AAS supplied to the D·I/F 10 from an external device such as another EG (not shown) connected to an analog input terminal 12. The converted signals are stored as DAD in FIFO 14, and then is output to the input/output device I/F 30. After DAD is output from the FIFO elements 14 and 15 and is input to the input/output device I/F 30, the DAD is output to a DSP (Digital Signal Processor) 31 as the signal processing means. The DSP 31 performs musical sound signal processing such as compressing encode processing, mixing, effect processing, and the like. Additionally, the interface apparatus has a D/A converter 19 interposed between a FIFO 16 of the input/output device interface 30 and an analog output terminal 13 for converting the digital audio signal into an analog audio signal for output through the analog output terminal 13.

According to commands from a main controller 32 that overall controls the entire of the D·I/F 10, the input/output device I/F 30 outputs DAD to the DSP 31 and inputs DAD from the DSP 31, and selects inputs and outputs from FIFO elements 14 through 17. The main controller 32 controls the input/output device I/F 30, an input/output controller 33, and a bus controller 35, and controls operations of a clock generating circuit 36 and the DSP 31. The input/output controller 33 controls input and output changeover of signals from two rotary pull-up/down volume control switches (hereafter referred to as "VCS") 20 and 21, one rotary pull-up/down tone (timbre) control switch (hereafter referred to as "TCS") 22, and seven push button effect switches (hereafter referred to as "PES") 23 through 29. These switches are connected to an input/output operation interface 34 (hereafter referred to as "input/output operation I/F"). The bus controller 35 controls a bus constructed between the D·I/F 10 and the PC 99 connected to the digital input/output terminal 11.

Figure 3:
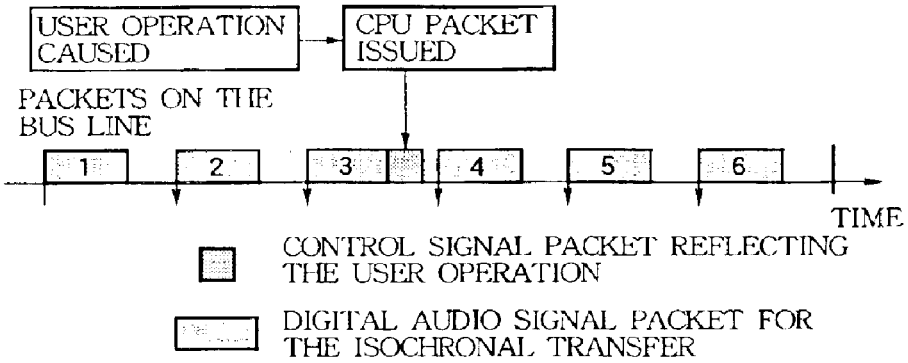
FIG. 3 schematically shows a data transfer scheme using the digital interface apparatus.
Figure 4:
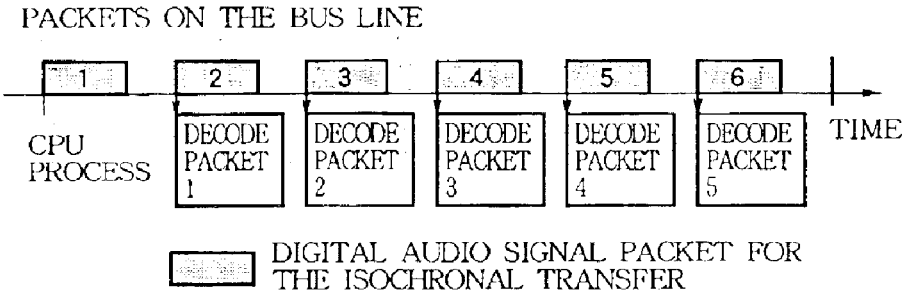
FIG. 4 schematically shows the isochronal transfer mode.
Figure 5:
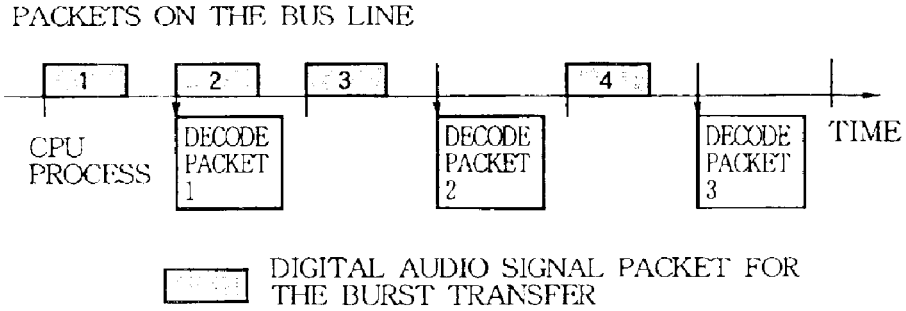
FIG. 5 schematically shows the burst transfer mode.

With reference to FIGS. 3 through 5, the following describes how the D·I/F 10 processes DAD (digital audio signal, control signal, and the like). The following description uses the USB as an example of serial bus line. The D·I/F 10 performs two types of data transfer systems (transfer modes), i.e., isochronal transfer mode and burst transfer mode. As shown in FIG. 3, the D·I/F 10 according to the present invention uses the isochronal transfer as data transfer for a digital audio signal as DAD on one signal bus line in connection with the PC 99 or the like. When an interrupt request occurs during the burst transfer, the D·I/F 10 transfers a control signal in accordance with the idle state of the bus line.

As shown in FIG. 4, the isochronal transfer ensures the amount of data transferred within a specified time. For example, the isochronal transfer is always used to process PCM (Pulse Code Modulation) data and the like. The isochronal transfer is also available for compressed digital audio signals and is used when accurate timing must be maintained between the data transfer and the decoding within a relatively short time. When sound data is recorded on the PC 99, for example, no decoding may be needed in such a manner that PCM data is transferred and the PCM data is written as is to an HDD (Hard Disk Drive) in the PC 99. Also in this case, the isochronism must be strictly observed during data transfer from the viewpoint of time management.

As shown in FIG. 5, the burst transfer is similar to the isochronal transfer in that the transfer rate is ensured within a specified time interval. However, the burst transfer needs less strict conditions than those of the isochronal transfer. The burst transfer is advantageous for compressed digital audio signals. The burst transfer can be activated only if the decode timing is satisfied. Only if buffering is available, data can be transferred at a burst when transferable. Accordingly, the burst transfer is used to transfer control signals.

Out of DAD, a digital audio signal is output from the pickup 3 of the EG 1 or from the PC 99 and is input to the D·I/F 10. The digital audio signal is then stored in the FIFO elements 14 and 15 as ring buffers to form one packet of a specified amount. During a normal operation, the main controller 32 provides synchronization between decode timing of the DSP 31 and transfer timing of the input/output device I/F 30 via the bus controller 35. The main controller 32 transfers one packet of data based on the isochronal transfer at each transfer timing. In this manner, the specified amount of digital audio signals is transferred periodically in synchronization with the transfer timing.

Out of DAD, control signals are generated in accordance with operations and the like of the VCSs 20 and 21, the TCS 22, and the PESs 23 through 29 on the EG 1, and are burst-transferred in favor of realtime requirements as mentioned above. That is to say, a player's operation or the like causes a control signal. When the input/output controller 33 requests to transfer an interrupt, the main controller 32 issues a control signal packet. The main controller 32 then burst-transfers the control signal packet via the bus controller 35 when the isochronal transfer is idle on the bus line. In this manner, the main controller 32 interchanges data by appropriately performing the isochronal transfer and the burst transfer according to data packets to be transferred. Namely, the bus controller 35 is provided for controlling a bus connecting between the main controller 32 and one or more of the external digital audio apparatus having a CPU through the input/output interface 30 for bi-directionally transferring audio data including the digital audio signal and a digital control signal effective to control processing of the digital audio signal. The bus controller 35 is operative in a stream mode for isochronously transferring the digital audio signal in a stream of packets at a constant rate, and is operative in a burst mode for transferring the digital control signal in a burst form.

The clock generating circuit 36 determines synchronization or asynchronization between a word clock of the PC 99 under control of the bus controller 35 and an operation clock of the main controller 32. The clock generating circuit 36 then selects and sets an appropriate clock and supplies it to the DSP 31 and the input/output device I/F 30. The bus controller 35 and the clock generating circuit 36 perform the similar processing when a plurality of PCs is connected. Namely, the clock generator 36 is provided for generating a clock signal adaptively set for operating the digital signal processor 31 and the input/out interface 30 in synchronization with a word clock used by the CPU of the external digital audio apparatus, so that the digital audio signal can be transferred synchronously between the digital interface apparatus and the external digital audio apparatus.

As mentioned above, the D·I/F 10 is provided with two VCSs 20 and 21, one TCS 22, and seven PESs 23 through 29 as operating members manipulable for operating the D·I/F 10. The VCSs 20 and 21, the TCS 22, and the PESs 23 through 29 are arranged at specified positions on the body 2 of the EG 1 so that a player or the like can easily actuate the operating members. Operation signals from the VCSs 20 and 21, the TCS 22, and the PESs 23 through 29 of the D·I/F 10 are supplied to the input/output operation I/F 34 and then to the main controller 32 via the input/output controller 33. The input/output controller 33 identifies the signals from the VCSs 20 and 21, the TCS 22, and the PESs 23 through 29, and outputs them to the main controller 32. Based on the instruction signal from the input/output controller 33, the main controller 32 issues commands to the DSP 31 and the input/output device I/F 30 and provides control to appropriately perform specified musical sound signal processing for the specified DAD.

The player or the like can apply a preferred effect and the like to the digital audio signal by the signal processing of the DSP 31 using the operating members such as the VCSs 20 and 21, the TCS 22, the PESs 23 through 29, and the like. When the VCSs 20 and 21, and the TCS 22 are pulled down in a normal state, for example, the VCSs 20 and 21 are used as volume control switches for directly outputting an AAS detected by the pickup 3 of the EG 1 to an analog output terminal; and the TCS 22 is used as a timbre control switch. When the VCSs 20 and 21, and the TCS 22 are pulled up, operation signals from the VCSs 20 and 21, and the TCS 22 are sent to the main controller 32 via the input/output operation I/F 34 and the input/output controller 33. Consequently, the VCSs 20 and 21, and the TCS 22 can be used as volume and timbre control switches for signal processing in the DSP 31 controlled by the main controller 32. Namely, the inventive digital interface apparatus has a switch member SW1–SW3 operable to switch the operating member 20–22 between an analog mode and a digital mode, such that the operating member 20–22 operates under the digital mode for inputting the instructions to the main controller 32, and operates under the analog mode for directly controlling at least a volume or a tone of the analog audio signal generated by the analog musical instrument.

Operation signals from the PESs 23 through 29 are also sent to the main controller 32 via the input/output operation I/F 34 and the input/output controller 33. The PESs 23 through 29 can be also used as switches to manipulate signal processing (especially effect processing) in the DSP 31 controlled by the main controller 32. In this example, the PES 23 is used as a switch for turning on or off the effect processing in the DSP 31 and as a digital/analog mode selection switch for the VCSs 20 and 21. The PESs 24 through 26 are used as parameter control switches for the effect processing in the DSP 31. The PESs 27 through 31 are used as preset switches to activate the effect processing preset for the DSP 31.

Figure 6:
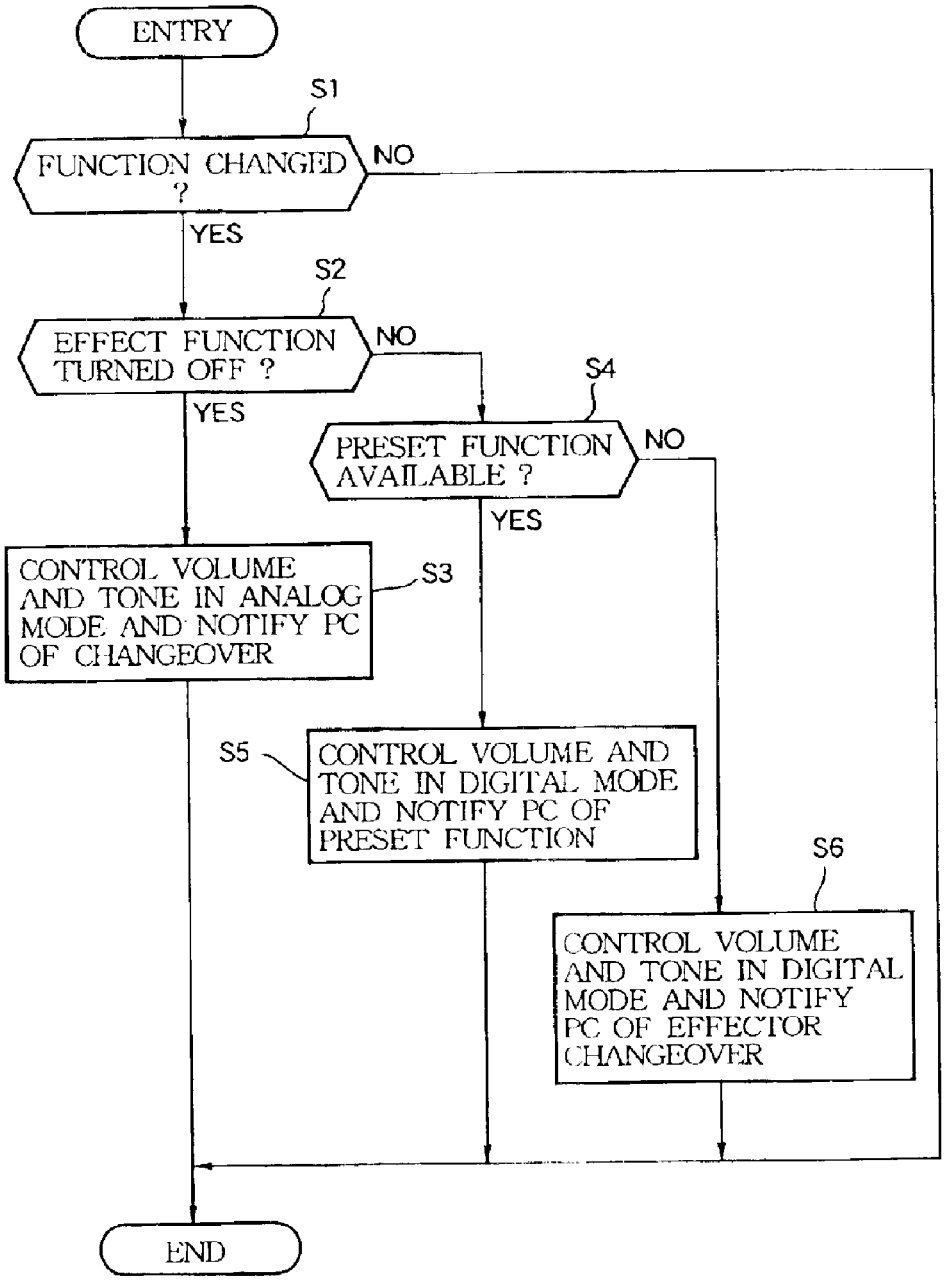
FIG. 6 is a flowchart showing an example of processing in the main controller accompanying volume control processing.

FIG. 6 is a flowchart showing an example of processing in the main controller 32 accompanying volume control processing through the use of the VCSs 20 and 21, the TCS 22, and the PESs 23 through 29.

When a player or the like pulls up or down the VCS s 20 and 21 or the TCS 22, the main controller 32 determines whether or not the function is changed (S1). If the function is not changed, the current state is maintained. If the function is changed at step S1, the main controller 32 determines the on/off state of the effect function controlled by presence or absence of an operation signal from the PES 23.

If the effect function is off, the main controller 32 enables analog option of the digital/analog selection switches SW1 through SW3 for the VCSs 20 and 21 and the TCS 22 so that the VCSs 20 and 21 and the TCS 22 can be used to adjust the volume and the timbre in analog mode. In addition, the main controller 32 sends a command for issuing a changeover notification to the PC 99 (S3). When the PC 99 activates an application (software) corresponding to the D·I/F 10, for example, the EG 1 can provide control to, e.g., allow the PC 99 to stop volume and timbre adjustment in digital mode in accordance with the changeover notification from the bus controller 35.

If the effect function is on, the main controller 32 enables digital option of the digital/analog selection switches SW1 through SW3 for the VCSs 20 and 21 and the TCS 22. In addition, the main controller 32 determines availability of a preset function in accordance with presence or absence of an operation signal from the PESs 27 through 29 (S4). If the preset function is on, the main controller 32 sends a command for allowing the bus controller 35 to issue a preset notification to the PC 99. In addition, the main controller 32 enables the DSP 31 to perform volume and timbre adjustment corresponding to the preset function using the VCSs 20 and 21 and the TCS 22 (S5). The PC 99 calls and activates a specified application program for preset effects and the like in response to the preset notification from the bus controller 35. The PC 99 enables the called application program or the like to perform volume and timbre adjustment in digital mode as mentioned above and to control parameters and the like preassigned in the application program or the like of the PC 99 by means of the VCSs 20 and 21 and the TCS 22.

If the preset function is off, the main controller 32 sends a command for allowing the bus controller 35 to issue an effect changeover notification to the PC 99. In addition, the main controller 32 allows the DSP 31 to perform volume and timbre adjustment corresponding to the effect function using the VCSs 20 and 21 and the TCS 22 (S6). The PC 99 changes a specified effect and the like in accordance with the effect changeover notification from the bus controller 35, and enables control of the volume and timbre adjustment as mentioned above, effect parameter adjustment, and the like. Since the EG 1 can control effects from the PC 99 having the effect function and allow the PC 99 to generate backing sound, for example, it becomes possible to provide multifarious representations and the like such as unison and minus-one performance.

Figure 7:
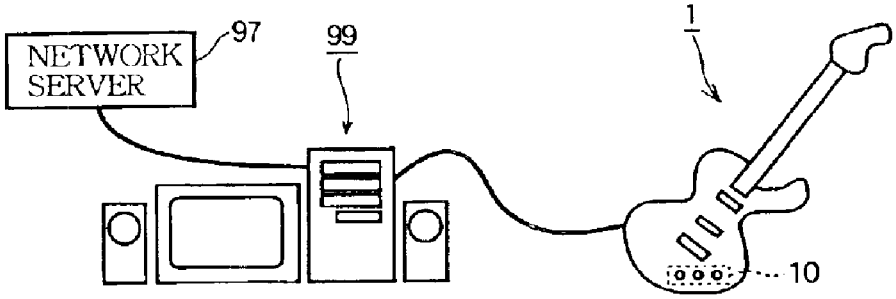
FIG. 7 shows an example of a system involving the analog musical instrument integrating the digital interface apparatus.
Figure 8:
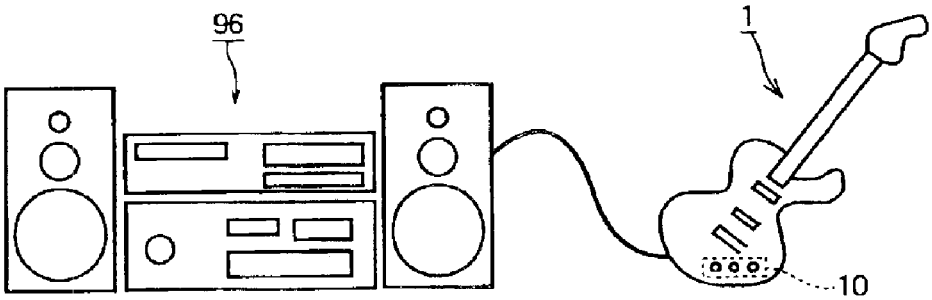
FIG. 8 shows another example of the system involving the analog musical instrument integrating the digital interface apparatus.
Figure 9:
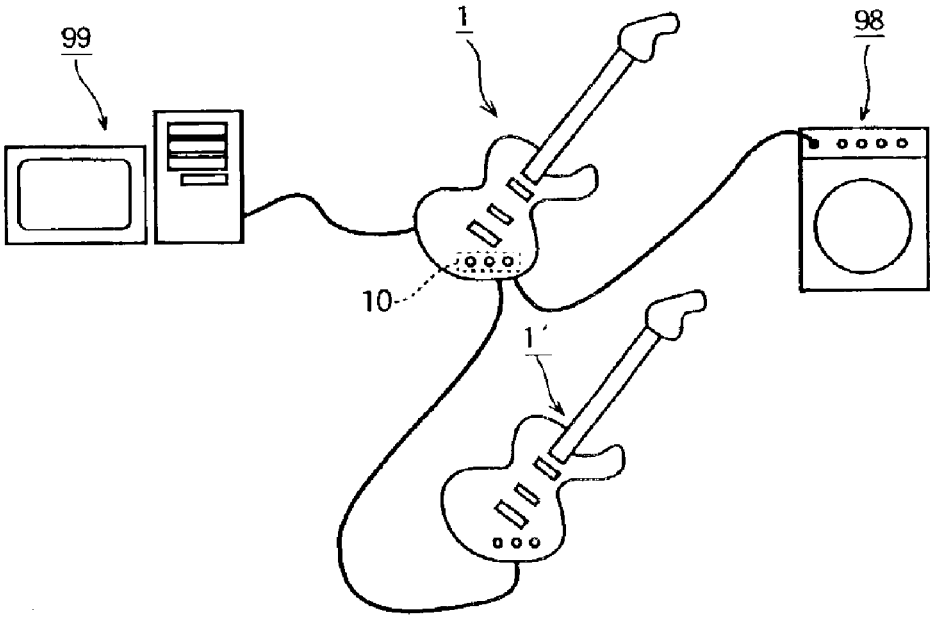
FIG. 9 shows yet another example of the system involving the analog musical instrument integrating the digital interface apparatus.

In this manner, the use of the D·I/F 10 enables not only musical sound signal processing in the D·I/F 10 according to the DSP 31, but also signal processing and the like in cooperation with the PC 99 and the like connected to the D·I/F 10. It is possible to improve operability and controllability. The above-mentioned example has described the connection between the EG 1 including the D·I/F 10 and the guitar amplifier 98. As shown in FIG. 7, however, the PC 99 connecting with the EG 1 can be further connected to an external network server 97 for musical performance, for example. Moreover, as shown in FIG. 8, the EG 1 can be connected and linked with an existing audio apparatus for musical performance. As shown in FIG. 9, it is possible to connect an ordinary EG 1' to the EG 1 that includes the D·I/F 10 and is connected to the guitar amplifier 98 and the PC 99. In addition, it is possible to connect a plurality of EGs 1 in a daisy chain fashion for musical performance, further improving operability and diversity. While the D·I/F 10 according to this example is built in the EG 1, it is obvious that the same effects are available on a D·I/F whether it is mounted on the EG 1 (external interface) or not. It is expected that the use of this D·I/F can allow the single EG 1 to control a plurality of PCs.

As mentioned above, the present invention provides the input/output device interface and the signal processing means in the digital interface of the analog musical instrument. This makes it possible to output a digital audio signal processed for musical sound directly to external AV apparatuses and the like. Accordingly, it is possible to suppress hardware investment costs of digitizing devices and the like that digitize the analog audio signal and digitally handle the analog musical instrument. Since the operation means can issue instructions to control the signal processing means, a user can supply the digital audio signal with musical sound signal processing such as effect processing at hand, thereby improving convenience. In addition, there is provided the input/output device interface having the digital input/output terminal. For example, it is expected to provide bidirectional control in such a manner that the operation means controls software for externally connected devices, and external devices and the like control operations of the signal processing means.

What is claimed is:

1. A digital interface apparatus provided for use in an analog musical instrument capable of generating an analog audio signal, and designed for interfacing with an external digital audio apparatus, the digital interface apparatus comprising:

an input/output interface for converting the analog audio signal generated by the analog musical instrument into a digital audio signal, the input/output interface having an input terminal and an output terminal for transmitting the digital audio signal to the external digital audio apparatus through the output terminal and for receiving a digital audio signal from the external digital audio apparatus through the input terminal;

a signal processor for processing the digital audio signal which is either converted from the analog audio signal or received from the input terminal;

a main controller for controlling operation of the signal processor according to instructions;

an operating member manually operative to provide the instructions to the main controller; and a bus controller for controlling a bus connecting between the main controller and one or more of the external digital audio apparatus having a CPU through the input/output interface for bi-directionally transferring audio data including the digital audio signal and a digital control signal effective to control processing of the digital audio signal, the bus controller being operative in a stream mode for transferring the digital audio signal in a stream of packets at a constant rate, and being operative in a burst mode for transferring the digital control signal in a burst form.

2. The digital interface apparatus according to claim 1, further comprising a clock generator for generating a clock signal adaptively set for operating the signal processor and the input/output interface in synchronization With a word clock used by the CPU of the external digital audio apparatus, so that the digital audio signal can be transferred synchronously between the digital interface apparatus and the external digital audio apparatus.

3. The digital interface apparatus according to claim 1, being integrated undetectably in the analog musical instrument.

4. The digital interface apparatus according to claim 1, being mounted detachably on the analog musical instrument.

5. The digital interface apparatus according to claim 1, wherein the signal processor processes the digital audio signal to impart thereto a desired effect.

6. The digital interface apparatus according to claim 1, further comprising a switch member operable to switch the operating member between an analog mode and a digital mode, such that the operating member operates under the digital mode for inputting the instructions to the main controller, and operates under the analog mode for directly controlling at least a volume or a tone of the analog audio signal generated by the analog musical instrument.

7. An analog musical instrument comprising:

a generator for generating an analog audio signal representative of a musical instrument sound;

an input/output interface for converting the analog audio signal generated by the generator into a digital audio signal, the input/output interface having an input terminal and an output terminal for transmitting the digital audio signal to an external digital audio apparatus through the output terminal and for receiving a digital audio signal from an external digital audio apparatus through the input terminal;

a signal processor for processing the digital audio signal which is either converted from the analog audio signal or received from the input terminal;

a main controller for controlling operation of the signal processor according to instructions; and an operating member manually operative to provide the instructions to the main controller; and a bus controller for controlling a bus connecting between the main controller and one or more of the external digital audio apparatus having a CPU through the input/output interface for bi-directionally transferring audio data including the digital audio signal and a digital control signal effective to control processing of the digital audio signal, the bus controller being operative in a stream mode for transferring the digital audio signal in a stream of packets at a constant rate, and being operative in a burst mode for transferring the digital control signal in a burst form.

8. The analog musical instrument according to claim 7, further comprising a clock generator for generating a clock signal adaptively set for operating the signal processor and the input/output interface in synchronization with a word clock used by the CPU of the external digital audio apparatus, so that the digital audio signal can be transferred synchronously between the analog musical instrument and the external digital audio apparatus.

9. The analog musical instrument according to claim 7, wherein the signal processor processes the digital audio signal to impart thereto a desired effect.

10. The analog musical instrument according to claim 7, further comprising a switch member operable to switch the operating member between an analog mode and a digital mode, such that the operating member operates under the digital mode for inputting the instructions to the main controller, and operates under the analog mode for directly controlling at least a volume or a tone of the analog audio signal generated by the generator.

* * * * *